US006547015B1

(12) United States Patent
Nowak, Jr. et al.

(10) Patent No.: US 6,547,015 B1
(45) Date of Patent: Apr. 15, 2003

(54) ELONGATED PNEUMATIC TOOL WITH REPLACEABLE SOFT GRIP

(75) Inventors: Dennis A. Nowak, Jr., Greendale, WI (US); Joshua M. Beer, Racine, WI (US); James R. Brehm, Racine, WI (US)

(73) Assignee: Snap-on Technologies, Inc., Lincolnshire, IL (US)

( * ) Notice: Subject to any disclaimer, the term of this patent is extended or adjusted under 35 U.S.C. 154(b) by 74 days.

(21) Appl. No.: 09/821,147

(22) Filed: Mar. 29, 2001

(51) Int. Cl.[7] ..... B25B 25/04

(52) U.S. Cl. ..... 173/169; 173/170; 16/110.1

(58) Field of Search ..... 173/168, 169, 173/170, DIG. 2, 171; 200/333; 181/230; 16/110.1, 421, 430

(56) References Cited

U.S. PATENT DOCUMENTS

| | | | | |
|---|---|---|---|---|
| 3,189,069 | A | 6/1965 | Stowell | |
| 3,225,861 | A | 12/1965 | Reynolds | |
| 3,379,278 | A | 4/1968 | Skowron | |
| 4,303,133 | A | 12/1981 | Godolphin | |
| 4,558,763 | A | 12/1985 | Montabert | |
| 5,017,109 | A | 5/1991 | Albert et al. | |
| 5,048,572 | A | 9/1991 | Levine | |
| 5,172,773 | A * | 12/1992 | Meister et al. | 173/170 |
| 5,189,267 | A | 2/1993 | Ligman | |
| D334,126 | S | 3/1993 | Huber et al. | |
| 5,244,521 | A | 9/1993 | Ligman | |
| 5,332,156 | A | 7/1994 | Wheeler | |
| 5,347,684 | A | 9/1994 | Jackson | |
| 5,353,474 | A | 10/1994 | Good et al. | |
| D355,422 | S | 2/1995 | Kimberlin | |
| 5,797,462 | A | 8/1998 | Rahm | |
| 5,944,119 | A * | 8/1999 | Hsieh | 173/170 |
| 5,954,142 | A | 9/1999 | Rahm | |
| 5,992,540 | A | 11/1999 | Smolinski et al. | |
| D427,871 | S | 7/2000 | Price | |
| 6,082,468 | A | 7/2000 | Pusateri et al. | |
| 6,155,354 | A * | 12/2000 | Pusateri et al. | 173/168 |
| 6,298,753 | B1 | 10/2001 | Izumisawa | |

FOREIGN PATENT DOCUMENTS

| | | |
|---|---|---|
| EP | 0 689 902 A1 | 1/1996 |

* cited by examiner

*Primary Examiner*—Scott A. Smith
(74) *Attorney, Agent, or Firm*—Seyfarth Shaw

(57) ABSTRACT

A housing for a pneumatic tool includes a head portion, a middle portion, and a handle portion. A sleeve is disposed over the middle portion of a pneumatic tool with a rear portion of the sleeve spaced from the outer surface of the housing. A grip made of pliant material, preferably rubber or a synthetic rubber compound encloses the handle portion. The grip includes a front lip, and a rear flange. Once fully inserted on the handle, the sleeve and the external surface of the housing cooperate to retain the front lip therebetween, preventing the front lip from peeling off the handle portion. An adaptor engages an air inlet at a distal end of the handle portion. The adaptor can include a washer engageable with the air inlet for limiting the depth of insertion of the adaptor in the air inlet and for inhibiting rearward movement of the grip.

14 Claims, 3 Drawing Sheets

ELONGATED PNEUMATIC TOOL WITH REPLACEABLE SOFT GRIP

BACKGROUND

This application relates generally to a pneumatic tool. More particularly, this application relates to an elongated pneumatic tool with a replaceable soft grip.

Elongated pneumatic hand tools such as air ratchets are well known. These devices typically include a head portion, a middle portion, and a handle portion, all of which may be disposed in longitudinal alignment. The head portion contains the drive end which couples to an attachment or a fastener to perform work. The middle portion contains a pneumatic motor which drives the rotary movement of the drive end. The handle portion provides an external surface for the user to grasp, and also includes an airway for the flow of compressed air into the pneumatic motor.

In order to operate an elongated pneumatic tool, the user must maintain a solid grip on the handle portion with one hand, while controlling the flow of compressed air into the tool with that same hand. This task is made more difficult because rotational torque generated during the use of the elongated pneumatic tool can cause the tool to slip from the grasp of the user. Vibrational forces generated during the normal operation may also cause the hand to lose its grip or may tire the hand, prematurely weakening the user's grip. Consequently, it is important that the handle portion provide good traction with the hand and also provide some damping of vibrational forces.

A grip may be disposed on the handle to provide better traction and/or thermal protection of the hand. The grip is usually made of a rigid plastic material because rigid plastic is generally more durable, and can be secured onto the handle in a conventional manner by using fasteners. However, these rigid grips provide little protection against vibrational forces, and they still provide less traction than grips made of more pliant materials, such as rubber.

Softer grips made of pliant materials dampen vibrations and readily conform to the user's hand for better traction, but they are typically not utilized because of the difficulty in retaining these grips on the handle portion. Pliant materials, such as rubber, typically degrade and fail when fastened onto a surface with a fastener. The pressure exerted on the material by the fastener typically wears down the area surrounding the fastener prematurely. Pliant materials can be glued onto the handle, but this is a permanent bond and makes replacing worn grips quite difficult. Pliant grips can also be inserted onto the handle without being fastened thereto, but dirt and debris tend to work themselves between the grip and the housing, reducing traction between the two and causing the grip to slide. Consequently, while there is a need for a pneumatic tool which has a grip portion that is made of a pliant material, this need has been left largely unsatisfied due to the difficulty of retaining a pliant grip on a handle.

SUMMARY

Therefore, this application to provides a pneumatic powered tool that avoids the disadvantages of prior designs while affording additional structural and operating advantages.

An important feature is the provision of a pneumatic tool with a pliant hand grip that is capable of absorbing a substantial amount of the vibrational forces that are generated during the normal operation of the tool.

Another important feature is the provision of a pneumatic tool with a pliant hand grip which provides greater traction between a user's hand and the tool.

Another important feature is the provision of a pneumatic tool with a pliant hand grip that is easily replaceable when worn down.

Another important feature is the provision of a pneumatic tool with a pliant hand grip that engages the external surface of the handle portion so as to prevent relative movement of the grip relative thereto.

Another important feature is the provision of a pneumatic tool with a hand grip that prevents the infiltration of materials between the grip and the handle.

Another important feature is the provision of a method of mounting a pliant hand grip on an elongated pneumatic tool.

BRIEF DESCRIPTION OFT HE DRAWINGS

For purposes of facilitating and understanding the subject matter sought to be protected, there is illustrated in the accompanying drawings an embodiment thereof, from an inspection of which, when considered in connection with the following description, the subject matter sought to be protected, its construction and operation, and many of its advantages should be readily understood and appropriated.

DETAILED DESCRIPTION

Figure 1:
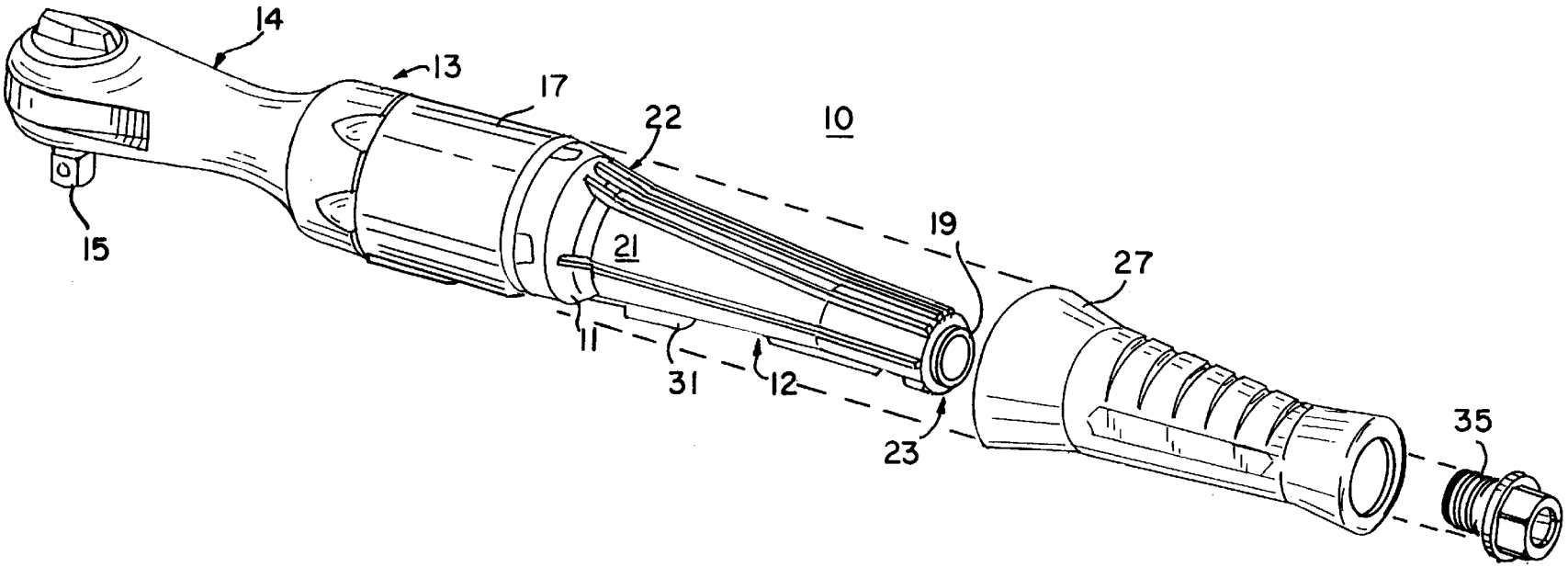
FIG. 1 is an exploded perspective of an embodiment of the pneumatic power tool and grip therefor.

Referring to FIG. 1, an embodiment of an elongated pneumatic tool 10 in accordance with the principles of this application is shown. This embodiment of the pneumatic tool 10 is configured as an air ratchet for the purpose of illustration only. A pneumatic tool in accordance with the principles of this application can be otherwise configured to perform other functions. The pneumatic tool 10 includes an elongated housing 11 which encloses a majority of the pneumatic tool 10. The housing 11 includes a handle portion 12, a cylindrical middle portion 13, and a head portion 14, all relatively linearly aligned.

Figure 2:
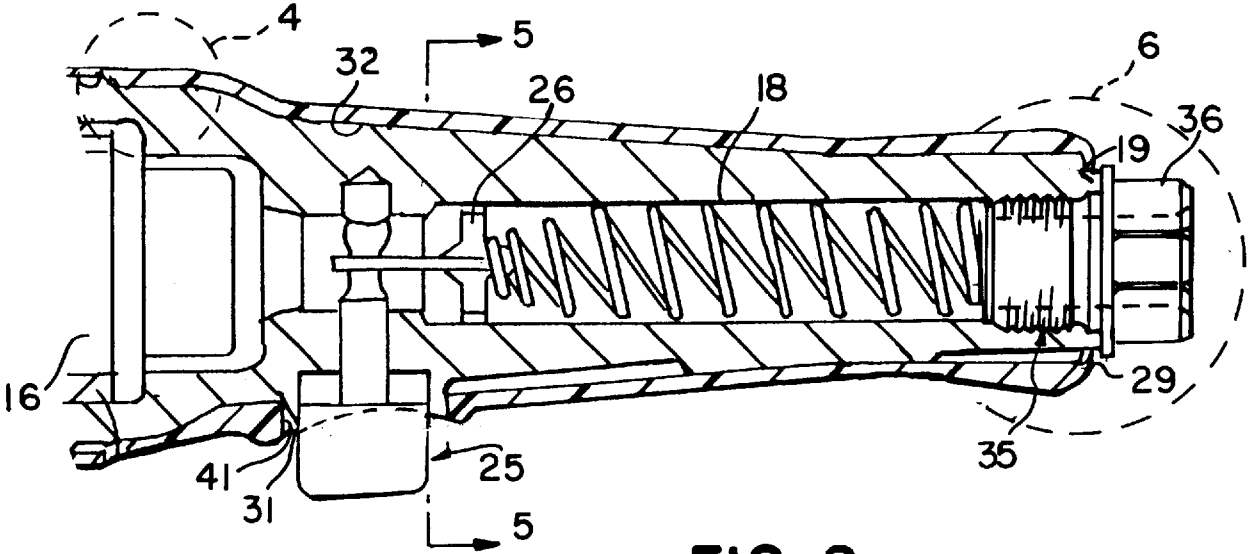
FIG. 2 is an enlarged sectional view of the handle portion of the pneumatic tool of FIG. 1.

The head portion 14 encloses a drive shaft (not shown) which is coupled through suitable gearing to a drive square 15 and to a pneumatic motor 16 (FIG. 2). A plurality of different attachments can engage the drive square 15, enabling the pneumatic tool 10 to perform a variety of tasks.

Figure 4:
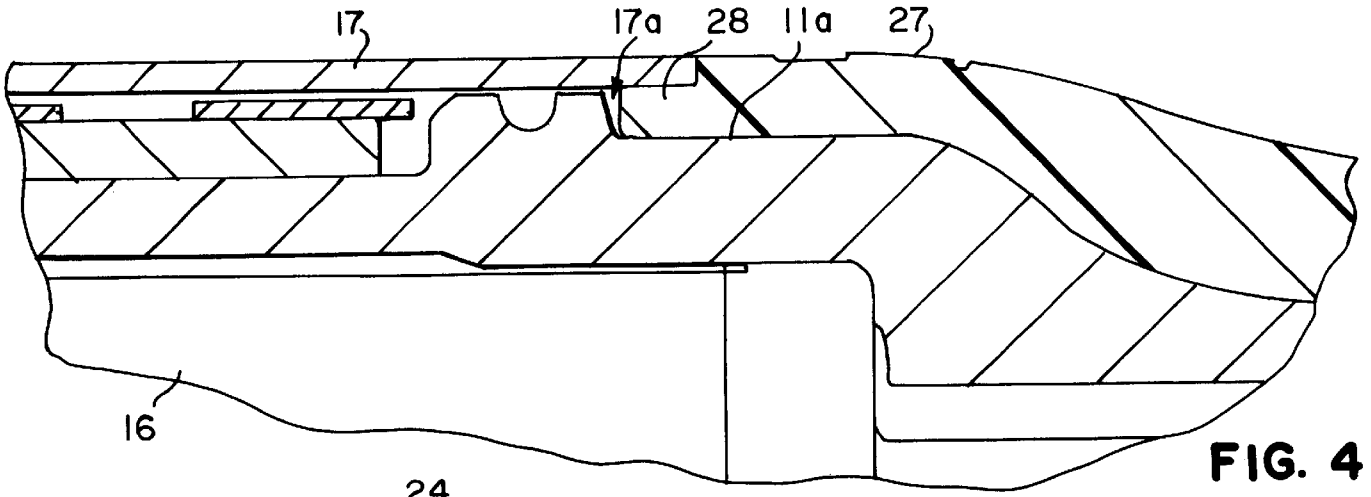
FIG. 4 is a further enlarged view of Area 4 in FIG. 2.

Referring also to FIGS. 2 and 4, the middle portion 13 houses the pneumatic motor 16 therein. A vent (not shown) can extend through the middle portion 13 to provide a pathway for exhaust to escape from the housing. A sleeve 17 can be disposed over the middle portion 13 to guide the flow of exhaust as it leaves the vent. Preferably, a rear portion of the sleeve 17 is spaced from the outer surface 11*a* of the housing 11, as at 17*a* (FIG. 4).

Figure 6:
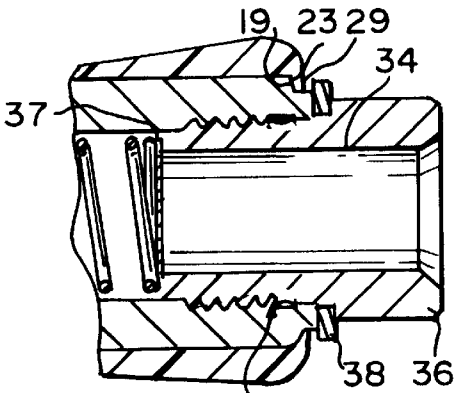
FIG. 6 is a further enlarged view of Area 6 in FIG. 2.

The handle portion 12 extends from the middle portion 13 defining an airway 18 therein and an air inlet 19 in communication with the airway 18. The handle portion 12 can include an elongated and generally frustoconical external surface 21, a proximal end 22 adjacent to the middle portion 13, and a distal end surface 23 from which the air inlet 19 projects (FIG. 6). A grip 27 is disposed on the eternal surface 21.

Figure 5:
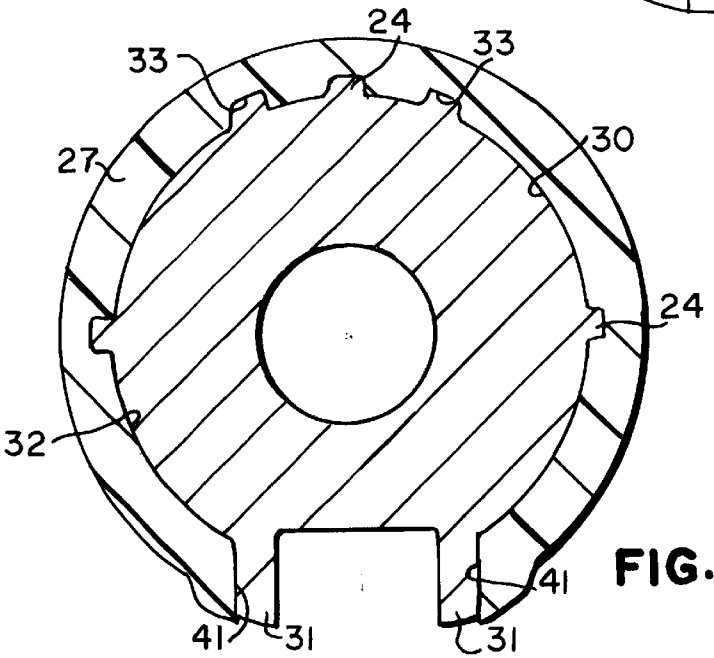
FIG. 5 is a further enlarged cross sectional view of the handle portion of FIG. 2 taken along lines 5—5.

Referring to FIGS. 1 and 5, a rib 24 may extend longitudinally on the external surface of the handle portion to prevent rotational movement of the grip relative to the handle portion 12. Preferably, a plurality of ribs 24 is utilized, with ribs spaced apart circumferentially to provide more uniform resistance to rotation.

Referring to FIGS. 2 and 5, a push-button mechanism 25 depends from the handle portion 12 and is coupled to a valve assembly 26 that controls flow of compressed air to the pneumatic motor. Depression of the push-button mechanism 25 opens the valve assembly 26 allowing compressed air to flow to the pneumatic motor. An wall 31 may extend from the external surface 21 surrounding the push-button mechanism 25 to inhibit axial and circumferential movement of the grip 27.

Figure 3:
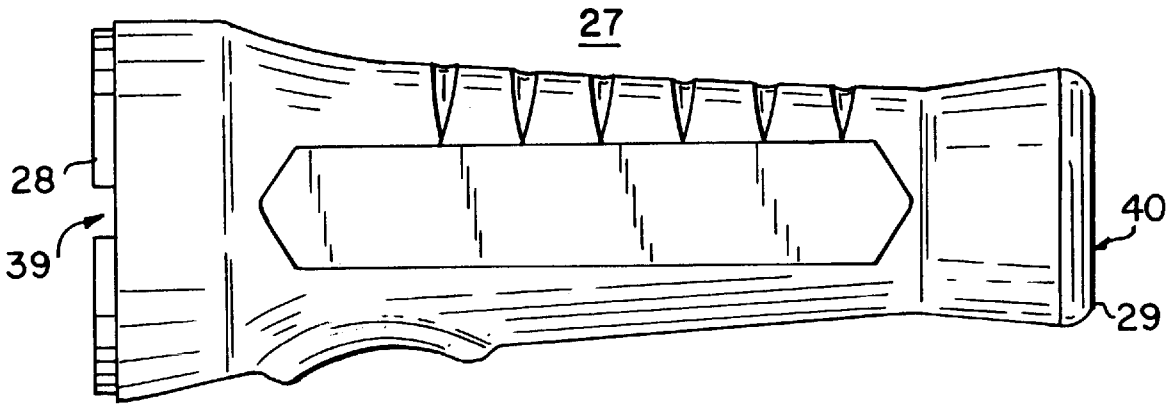
FIG. 3 is a side elevational view of the hand grip of the tool of FIG. 2.

Referring to FIGS. 2, 3 and 5, the grip 27 is made of a pliant material, preferably rubber or a synthetic rubber compound. The grip defines an internal cavity 32 sized to enclose the handle portion 12 therein and has a front lip 28, defining a proximal end opening 39, and a rear flange 29 which wraps over the distal end surface 23 of the handle portion 12 and defines a distal end opening 40. The grip is preferably ergonomically shaped to accommodate a user's hand.

The interior cavity 32 of the grip 27 has an internal surface 30 which may include channels 33 extending longitudinally thereon. The channels 33 are arranged complementary to the ribs 24 on the handle portion 12, and are dimensioned to respectively receive the rib 24. An aperture 41 can extend through the grip 27 to receive the wall 31.

Referring to FIGS. 2 and 6, an adaptor 35 engages the air inlet 19 of the handle portion 12. The adaptor can include a bushing 36 which defines a passageway 34 therein. A filter screen 37 can extend across the passageway to filter debris carried by the compressed air. The adaptor 35 can include a washer 38 engageable with the air inlet 19 for limiting the depth of insertion of the adaptor 35 in the air inlet 19.

Referring to FIGS. 4, 5, and 6, the grip 27 is secured onto the handle by first aligning the channels 33 with the ribs 24, and inserting the handle portion 12 into the proximal end opening 39 of the grip 27. Once fully inserted, the sleeve 17 and the external surface of the housing 11 at 11*a* (FIG. 4) cooperate to retain the front lip 28 therebetween, preventing the front lip 28 from peeling off the handle portion 12. Each rib 24 should be disposed within a channel 33, thereby preventing rotation of the grip relative to the handle portion. The rear flange 29 engages the distal end surface 23 of the handle portion 12.

The adaptor 35 is inserted into the air inlet 19 and is preferably threadedly secured to the airway 18. The washer 38 abuts the air inlet 19 and prevents further axial movement within the airway 18. The washer 38 has outer diameter greater than the diameter of the distal end opening 40 defined by the rear flange 29 to protect the rear flange 29 from catching on objects which might cause it to peel back from the handle, and to inhibit rearward movement of the grip 27. The air inlet 19 projects rearwardly from the distal end surface 23 a distance greater than the thickness of the rear flange 29 so that the washer 38 doesn't touch the flange 29 during installation of the adaptor 35. Thus, the washer 38 does not apply direct pressure on the rear flange 29, which might cause twisting of the rear flange during tightening of the bushing 36.

The use of pliant materials, such as rubber, to form a grip which covers a handle of an elongated pneumatic tool has several advantages. Pliant grips provide increased damping of vibrations which propagates through a pneumatic tool during normal operation, reducing discomfort to the user's hands. Furthermore, a pliant grip yields to the contours of a user's hand, enabling the grip to provide for greater comfort during use and increasing the traction between the user's hand and the tool.

The matter set forth in the foregoing description and accompanying drawings is offered by way of illustration only and not as a limitation. While a particular embodiment has been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A pneumatic tool comprising:

an elongated housing having a middle portion and a handle portion extending longitudinally therefrom, the middle portion having a sleeve disposed thereon, the handle portion having an external surface, a proximal end adjacent to the middle portion and a distal end which defines an air inlet;

a detachable grip defining an internal cavity sized to accommodate the handle portion, and having a front lip and a rear flange, the grip being disposed on the handle with the sleeve and the external surface in cooperation to retain the front lip therebetween and with the rear flange engaging the air inlet; and an adaptor defining an air passage inserted into the air inlet.

2. The pneumatic tool of claim 1, where the adaptor includes a washer and a bushing, the washer abutting directly against the air inlet when the adaptor is fully inserted into the air inlet, the washer cooperating with the distal end of the handle portion to protect the rear flange of the grip from peeling.

3. The pneumatic tool of claim 1, wherein the grip is formed of a synthetic rubber material.

4. The pneumatic tool of claim 1, wherein the handle portion has a plurality of ribs, and wherein the internal surface of the grip has channels positioned to respectively receive the ribs.

5. The pneumatic tool of claim 1, wherein the adaptor includes a filter screen extending across the air passage.

6. The pneumatic tool of claim 1, and further comprising a push-button mechanism depending from the handle portion, and wherein an annular wall extends from the external surface to surround the push-button mechanism, the grip having an aperture therethrough sized to engage the annular wall.

7. The pneumatic tool of claim 1, wherein the grip has an external surface ergonomically shaped to accommodate a user's hand.

8. A pneumatic tool comprising:

a housing having a middle portion and a handle portion extending longitudinally therefrom, the handle portion having an external surface, a proximal end adjacent to the middle portion, and a distal end which defines an end surface and an air inlet projecting therefrom;

a grip having a front lip and a rear flange, the grip disposed on the external surface of the handle portion and the rear flange overlying the end surface; and an adaptor secured to the inlet, the adaptor defining an air passage and including a washer and a bushing, the washer abutting directly against the air inlet when the adaptor is fully inserted into the air inlet, the air inlet projecting beyond the rear flange so that the washer can engage the air inlet without touching the rear flange.

9. The pneumatic tool of claim 8 and further comprising means for preventing rotation of the grip relative to the handle, the means including complementary structures located on the external surface of the handle portion and on the internal surface of the grip.

10. The pneumatic tool of claim 9, wherein the housing includes a sleeve disposed on the middle portion and partially extending over the handle portion, the sleeve and the external surface cooperating to retain the front lip therebetween.

11. The pneumatic tool of claim 10, wherein the means for preventing rotation includes a plurality of ribs extending longitudinally along the external surface of the handle portion and arranged in diametrically opposed pairs, and channels positioned on the internal surface of the grip to respectively receive the ribs.

12. The pneumatic tool of claim 11 wherein the grip is formed of a synthetic rubber material.

13. The pneumatic tool of claim 12 wherein the adaptor assembly includes a filter screen extending across the air passage.

14. The pneumatic tool of claim 13, and further comprising a push-button mechanism depending from the handle portion, an annular wall extending from the external surface of the handle portion surrounding the push-button mechanism, and wherein the grip includes an aperture sized and positioned to engage the annular wall to inhibit axial and circumferential movement of the grip.

* * * * *